US011486161B2

(12) United States Patent
He

(10) Patent No.: US 11,486,161 B2
(45) Date of Patent: Nov. 1, 2022

(54) TENT CENTER HUB

(71) Applicant: Linhai Meideng Lighting Co., Ltd, Zhejiang (CN)

(72) Inventor: Long He, Zhejiang (CN)

( * ) Notice: Subject to any disclaimer, the term of this patent is extended or adjusted under 35 U.S.C. 154(b) by 0 days.

(21) Appl. No.: 17/226,047

(22) Filed: Apr. 8, 2021

(65) Prior Publication Data

US 2022/0064981 A1 Mar. 3, 2022

(30) Foreign Application Priority Data

Sep. 2, 2020 (CN) ..... 202021894264.3

(51) Int. Cl.
*E04H 15/48* (2006.01)
*E04H 15/02* (2006.01)

(52) U.S. Cl.
CPC ..... *E04H 15/48* (2013.01); *E04H 15/02* (2013.01)

(58) Field of Classification Search
CPC ..... E04H 15/48; E04H 15/44; E04H 15/02; A45B 2200/1027
USPC ..... 135/120.3
See application file for complete search history.

(56) References Cited

U.S. PATENT DOCUMENTS 6,840,657 B2 * 1/2005 Tung ..... A45B 3/04 362/183
7,461,668 B2 * 12/2008 Wu ..... E04H 15/44 135/91
9,968,168 B2 * 5/2018 Ma ..... A45B 3/02
10,458,145 B2 * 10/2019 Cantwell ..... E04H 15/10
2003/0137831 A1 * 7/2003 Lin ..... F21V 23/0442 362/153.1
2005/0059428 A1 * 3/2005 Tung ..... H04B 1/08 455/556.1
2007/0056617 A1 * 3/2007 Li ..... F21V 33/006 135/91
2007/0151588 A1 * 7/2007 Yul ..... E04H 15/50 135/135
2007/0211450 A1 * 9/2007 You ..... A45B 3/04 362/245
2008/0000513 A1 * 1/2008 Yul ..... H02S 10/40 136/244

FOREIGN PATENT DOCUMENTS

CN 2911098 Y * 6/2007 ..... E04H 15/10
WO WO-2017051253 A1 * 3/2017 ..... E04H 15/02

* cited by examiner

*Primary Examiner* — David R Dunn
*Assistant Examiner* — Danielle Jackson
(74) *Attorney, Agent, or Firm* — Prakash Nama; Global IP Services, PLLC

(57) ABSTRACT

A tent center hub, having a frame that hinges with top rods of the tent, also containing a top seat wherein a solar energy conversion and storage mechanism is mounted; a bottom side of the top seat is provided with an annular press ring protruded away from the top seat; a top side of the frame is provided with an annular block ring protruded away from the frame; the top seat is removably connected to the top side of the frame; a cavity inside the top seat and a cavity inside the frame are in mutual communication with each other; the block ring is disposed within an enclosure of the press ring; a gap exists along a longitudinal direction between a bottom side of the press ring and the frame. The tent center hub can provide lighting inside the tent.

9 Claims, 7 Drawing Sheets

TENT CENTER HUB

BACKGROUND OF THE INVENTION

The present invention relates to the technical field of lighting in the tent, and more specifically relates to a tent center hub.

Tents are widely used in various outdoor camp sites and scenery spots, so that when users are having their leisure time outdoor, the tents serve as shelters as well as wind and rain shields for the users. Also, the tents can block fierce sunlight and protect users from bad weather conditions.

An example of a prior art tent is disclosed in CN203547226U where a structure of the eave of a foldable tent is described. The foldable tent described in said Chinese patent comprises a top frame, at least three poles supporting the top frame, and a top cover covering the top frame; the top frame comprises first rods and eave rods, each of the poles is fixed with a fixation seat 43 at a top end thereof and also has a horizontal rotator and a vertical rotator; each horizontal rotator is pivotally connected with the corresponding fixation seat and the pivot axis is vertically arranged; each of the vertical rotator is pivotally connected with the corresponding horizontal rotator and a pivot axis between them is horizontally arranged; each of the vertical rotator is fixedly connected with a corresponding first rod; and each eave rod can slide with respect to the corresponding vertical rotator.

However, outdoor leisure venues are usually not provided with lighting apparatus. Therefore, while using the tent as described in the above Chinese patent, users have to bring lighting apparatus into the tent, and the lighting apparatus is usually hanged on the supporting frame of the tent by using metal wires or other fixing means. The procedures of mounting and fixing the lighting apparatus are complicated, and the lighting apparatus has to be dismounted when the tent has to be unfolded. Moreover, tangling electrical wires in the tent may cause a higher safety risk.

BRIEF SUMMARY OF THE INVENTION

In view of the aforesaid disadvantages now present in the prior art, the present invention provides a kind of tent center hub. The technical solution provided by the present invention is to provide lighting in the tent.

The object of the present invention is achieved through the following technical solution: a tent center hub, comprising a frame that hinges with top rods of the tent, characterized in that, the tent center hub also comprises a top seat wherein a solar energy conversion and storage mechanism is mounted; a bottom side of the top seat provided with an annular press ring protruded away from the top seat; a top side of the frame is provided with an annular block ring protruded away from the frame; the top seat is removably connected to the top side of the frame; a cavity inside the top seat and a cavity inside the frame are in mutual communication with each other; the block ring is disposed within an enclosure of the press ring; a gap exists along a longitudinal direction between a bottom side of the press ring and the frame;

the tent center hub is positioned at a center point of a top side of the tent; one end of each top rod is hinged with the frame; a tent covering fabric has a hole at its center; the top side of the frame partially passes through the hole of the tent covering fabric; the top seat is removably connected with the frame; the press ring press the tent covering fabric tightly against the frame in such a way that the solar energy conversion and storage mechanism is positioned at the center of the tent; the solar energy conversion and storage mechanism converts solar energy into electrical energy; since the cavity inside of the top seat and the cavity inside the frame are in mutual communication with each other, wires can be extended to the cavity inside the top seat through the cavity inside the frame to achieve electrical conduction. Therefore, the light beads can be provided on each of the top rod, so that the tent is equipped with lighting function. The gap is configured to provide mounting space of the tent covering fabric to prevent damage of the tent covering fabric when the frame and the top seat are connected; the press ring and the block ring has rain-shielding effect to prevent rain water from entering into the tent through the tent center hub.

According to an embodiment, a top surface of the top side of the frame exterior to the block ring has a slanted configuration slanted downwardly from the block ring to a periphery of the frame. This slanted configuration corresponds to the shape of the tent covering fabric when the tent is erected. Another purpose of this slanted configuration is to allow water to slide down so that water will not enter into the tent through the tent center hub.

According to an embodiment, the frame comprises a connecting frame which has a polygonal shape; each side of the connecting frame is provided with a pair of hinging plates extending away from the corresponding side of the connecting frame for hinging a corresponding top rod; a wiring hole is provided on each side of the connecting frame between a corresponding pair of hinging plates. The wiring holes are provided such that one each of each wire can be extended into the top rod while another end of which can be extended into the top seat through the connecting frame; the wiring holes are positioned such that spaces can be reasonably utilized such that wires will not expose and the wires will not be easily damaged.

According to an embodiment of the present invention, a bottom side of the connecting frame is fixedly connected with a press board; a fixing groove wherein a wiring board is embedded and fixed inside is provided between the connecting frame and the press board; a bottom side of the press board is provided with a lamp shade which is protruded away from the press board. The press board can press the wiring board tightly in the fixing groove. The lamp shade allows light beads to be directly mounting to the wiring board to achieve lighting effect.

According to another embodiment of the present invention, a bottom side of the connecting frame is fixedly connected with a press board; a fixing groove wherein a wiring board can be embedded and fixed inside is provided between the connecting frame and the press board; a middle part of the press board is provided with a hole. The press board can press the wiring board tightly in the fixing groove. The hole at the middle part of the press board allows better signal communications and controls the colors and brightness etc. of the light beads inside the tent.

According to an embodiment, the top side of the frame is provided with a first connecting ring protruded away from the frame; the first connecting ring is disposed within an enclosure of the block ring; an outer side wall of the first connecting ring has a plurality of connecting blocks protruding radially away from the first connecting ring; a bottom side of the top seat is provided with a second connecting ring protruded away from the top seat; an inner side wall of the second connecting ring is correspondingly provided with a plurality of locking grooves recessed radially into the inner side wall of the second connecting ring; by inserting the connecting blocks correspondingly into the locking grooves and then by mutual rotation of the frame and the top seat, the top seat and the frame are removably connected with each other. Such kind of connection is convenient in terms of both connecting and disconnecting.

According to another embodiment, the top side of the frame is provided with a first connecting ring protruded away from the frame; the first connecting ring is disposed within an enclosure of the block ring; an outer side wall of the first connecting ring is provided with outer threads; the bottom side of the top seat is provided with a second connecting ring protruded away from the top seat; an inner side wall of the second connecting ring is provided with inner threads; the first connecting ring and the second connecting ring are threadedly connected with each other so that the top seat and the frame are removably connected with each other. Threaded connection is very firm and secured, and is convenient in terms of both connecting and disconnecting.

According to an embodiment of the present invention, the top seat comprises a top cover and a lower housing; the top cover and the lower hosing are removably connected via tightening pieces; a cavity is defined between the top cover and the lower housing; a positioning groove 26 wherein solar cells are mounted is provided at a top side of the top cover; a plurality of mounting studs on which a solar energy control board is mounted are provided at a middle part of a bottom side of the top cover; two side portions of the bottom side of the top cover are symmetrically arranged with two mounting frames respectively wherein solar storage batteries are mounted inside respectively. By means of these configurations described in this paragraph, various components inside the top seat are evenly arranged and forces acted on the top seat are balanced and evenly distributed, thereby increasing the mounting stability of the top seat.

According to an embodiment of the present invention, edges of the top cover are provided with connecting grooves recessed into the top cover; edges of the lower housing are embedded correspondingly into the connecting grooves of the top cover. Seal rings may also be provided at the connecting grooves to increase the sealing effect of the top seat and the firmness of connection of the top seat.

According to an embodiment of the present invention, a USB charging port is provided inside the lower housing; the USB charging port is configured between the press ring and the block ring. In cloudy and rainy days, the top seat can be dismounted, and charging can be achieved via the USB charging port so that batteries contain sufficient power to perform lighting effect even in cloudy and rainy days.

Compared with the prior art, the tent center hub according to the present invention has the following advantages:

1. A solar energy conversion and storage mechanism provided in the tent center hub can supply power, so that wires and light beads can be directly mounted in the top rods of the tent, and the light beads can be powered up to emit lights, such that the tent is equipped with lighting function.

2. The tent center hub of the present invention can be dismounted, and is easy to assemble. Also, in cloudy and rainy days, the top seat can be dismounted to enable charging of power via the USB charging port, and as such, the tent of the present invention is equipped with lighting function in any weather condition.

Figure 1:
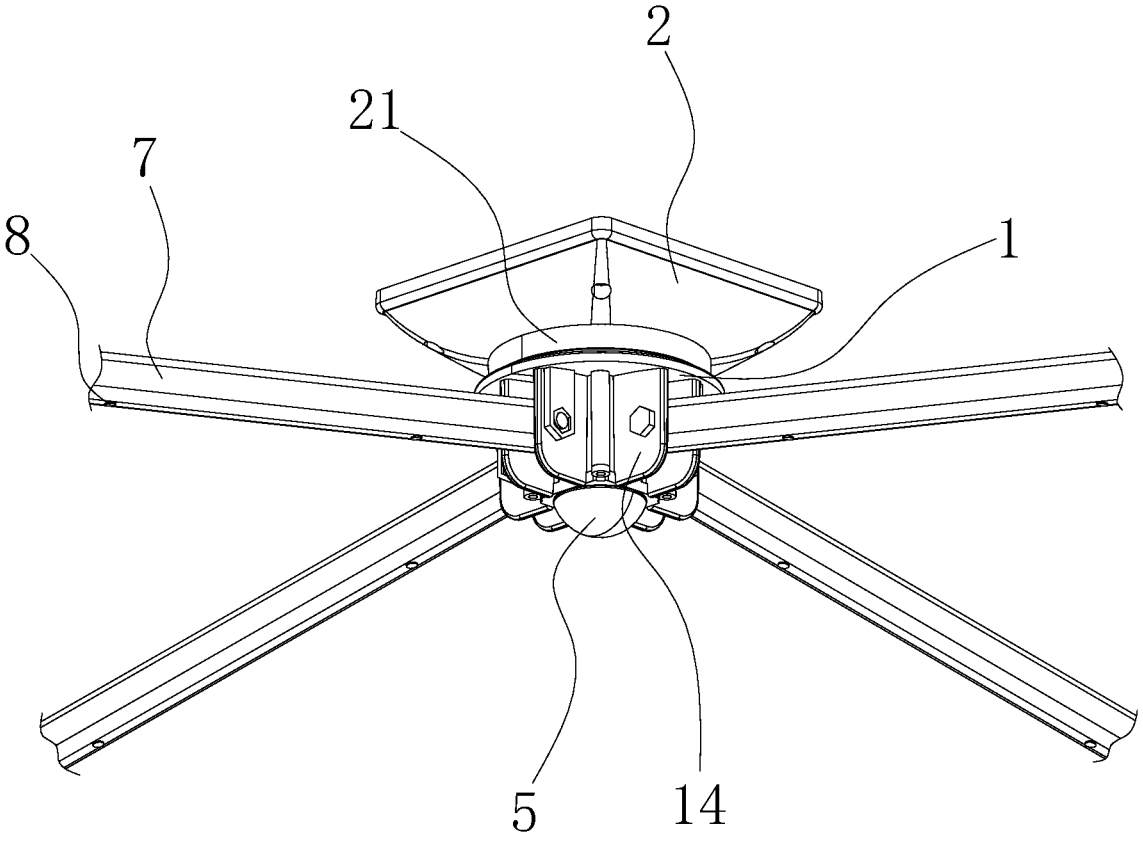
FIG. 1 is an overall schematic structural view according to a first embodiment of the tent center hub.

References in the drawings: frame 1, block ring 11, top surface 12, connecting frame 13, wiring holes 131, hinging plates 14, first connecting ring 15, connecting blocks 16, top seat 2, press ring 21, second connecting ring 22, locking grooves 23, top cover 24, connecting grooves 241, lower housing 25, positioning groove 26, mounting studs 27, mounting frames 28, USB charging port 29; press board 3, fixing groove 4, lamp shade 5, hole 6, top rod 7, light beads 8, wire 9, PCB 10.

DETAILED DESCRIPTION OF THE INVENTION

The technical solution provided by the present invention is further described in detail below with reference to several embodiments and the drawings. However, it is understood that the present invention should not be limited to the described embodiments.

Embodiment 1

Figure 2:
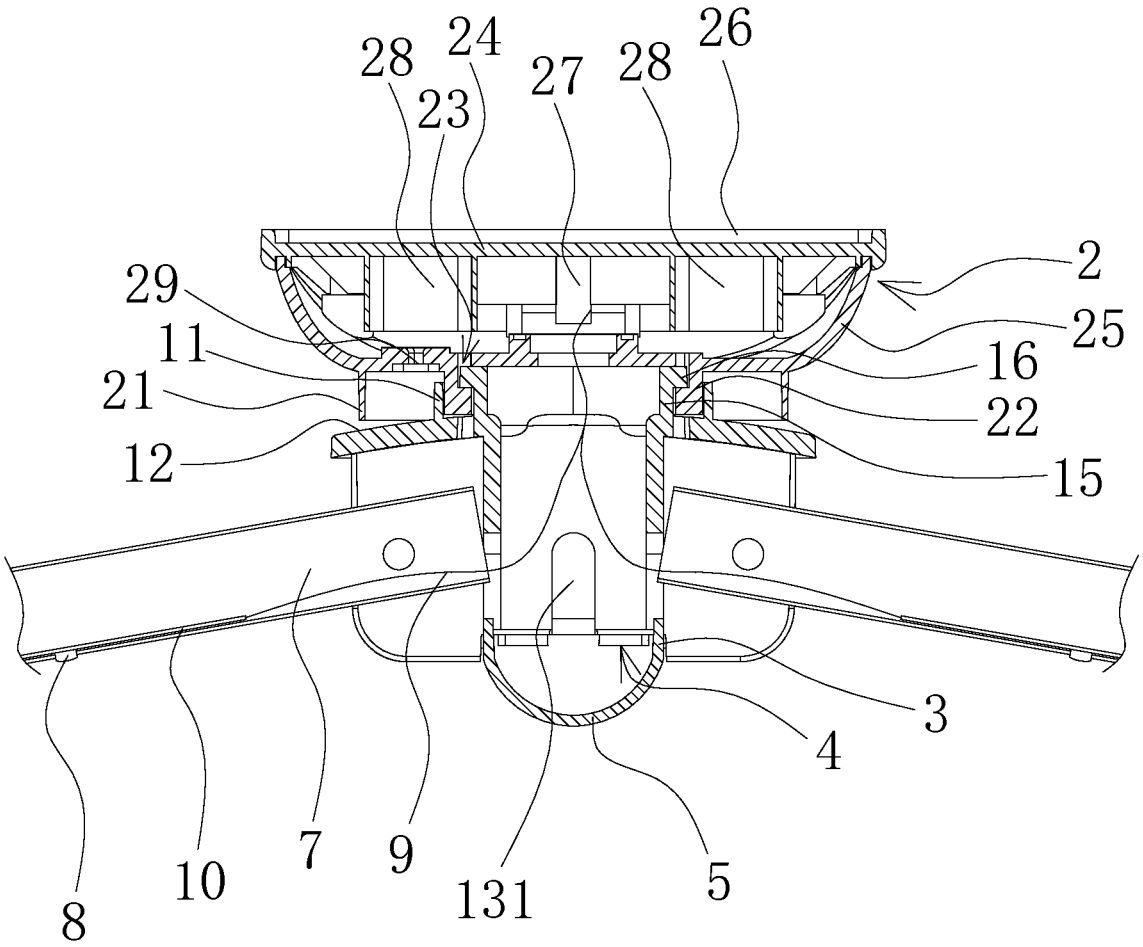
FIG. 2 is an overall sectional structural view according to the first embodiment of the tent center hub.

As shown in FIG. 1 and FIG. 2, the tent center hub of the present invention comprises a frame 1, and top seat 2 and a press board 3.

Figure 3:
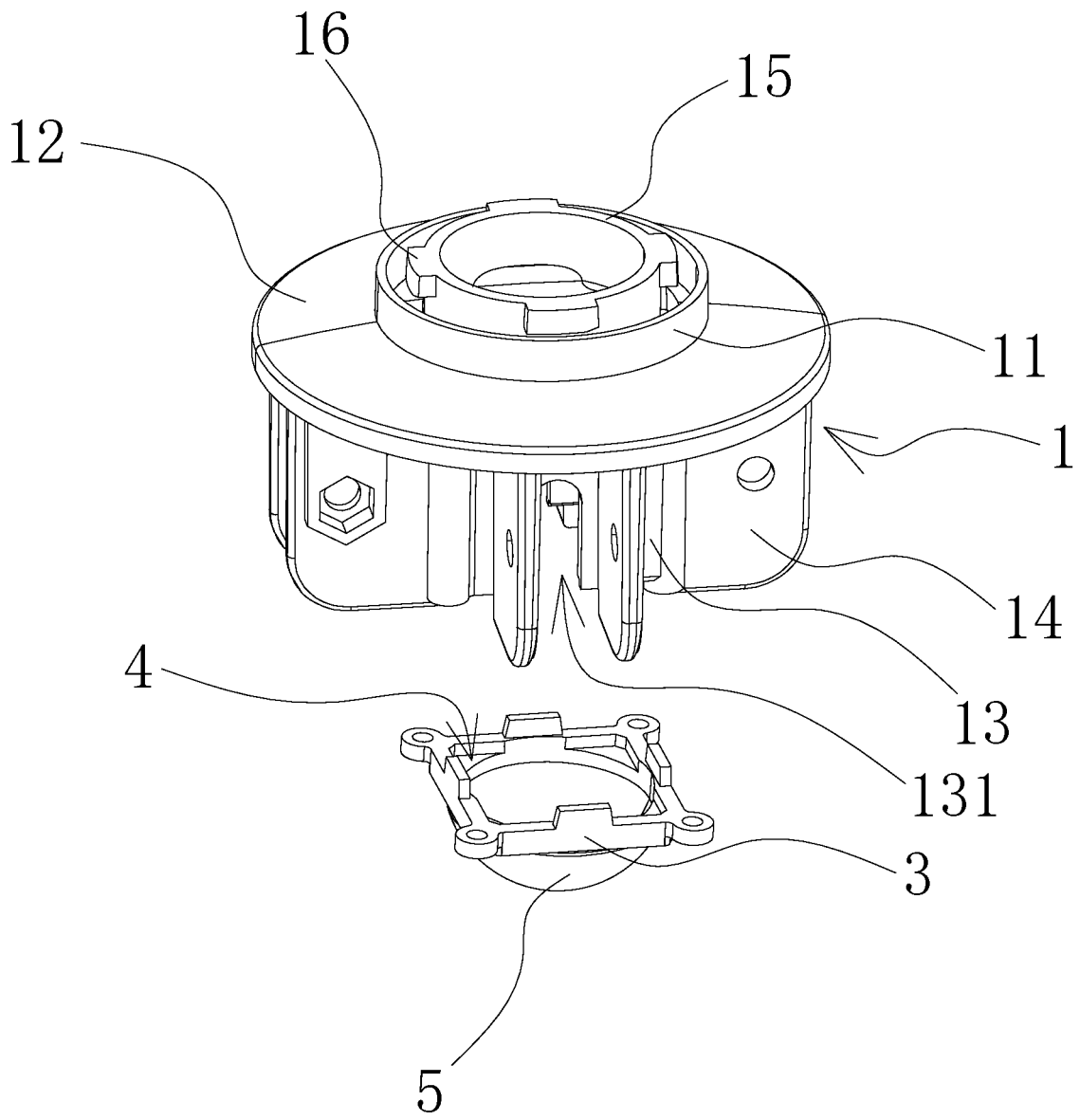
FIG. 3 is an exploded view showing the frame and the press board according to the first embodiment of the tent center hub.
Figure 4:
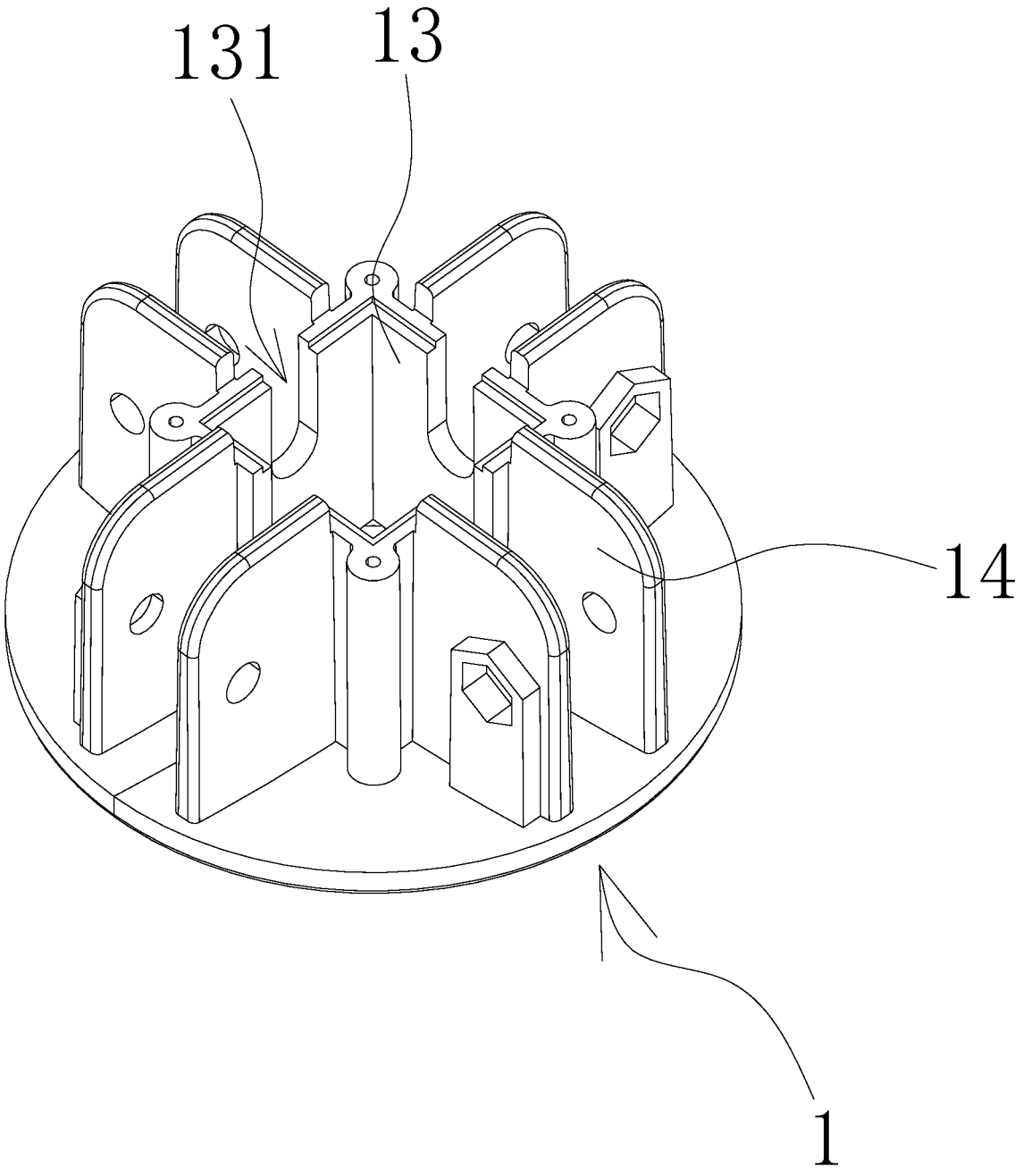
FIG. 4 is an overall schematic structural view of the frame of the tent center hub.

As shown in FIG. 3 and FIG. 4, in this embodiment, the frame 1 comprises a connecting frame 13 in a square shape; each side of the connecting frame 13 is provided with a pair of hinging plates 14 extending away from the corresponding side of the connecting frame 13 for hinging a top rod 7; a wiring hole 131 is provided on each side of the connecting frame 13 between a corresponding pair of hinging plates 14. The wiring holes 131 is in communication with a cavity inside the frame 1; each top rod 7 is configured to be hollow inside; a side wall of each top rod 7 is provided with a plurality of through holes; each top rod 7 is fixedly connected inside with a printed circuit board (PCB) 10; each PCB 10 is fixedly connected with a plurality of light beads 8 embedded respectively into the corresponding through holes and partially exposed from the corresponding top rod 7; an end of each PCB 10 proximal to the frame is connected with a wire 9; each wire 9 passes through a corresponding wiring hole 131, the cavity inside the frame 1, and then extends into a cavity inside the top seat 2 where it is connected with a solar energy conversion and storage mechanism. In actual production, the connecting frame 13 can be hexagonal or octagonal; a bottom side of the connecting frame 13 is fixedly connected with the press board 3; a fixing groove 4 wherein a wiring board can be embedded and fixed inside is provided between the connecting frame 13 and the press board 3; a bottom side of the press board 3 is provided with a lamp shade 5 which is protruded away from the press board.

Figure 5:
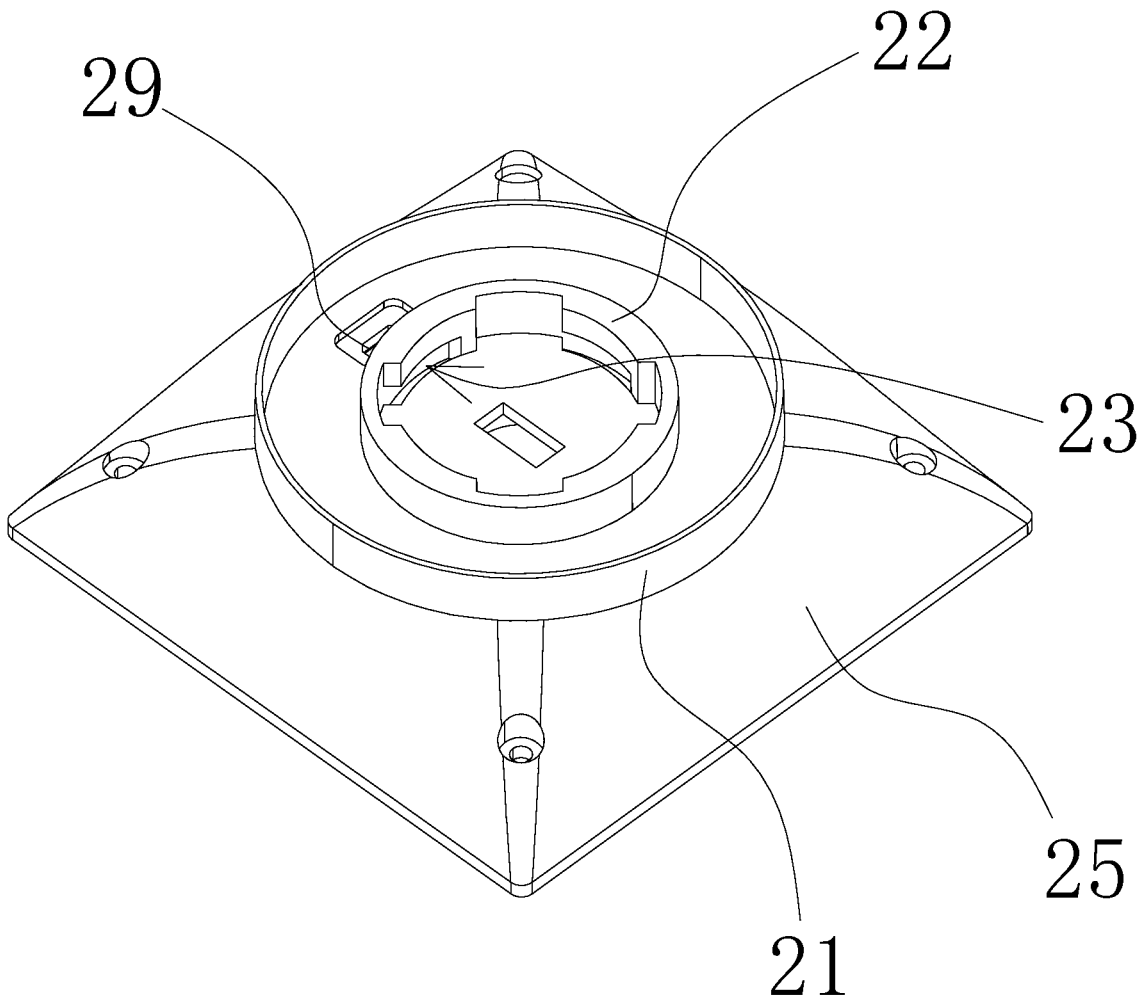
FIG. 5 is an overall schematic structural view of the lower housing of the tent center hub.
Figure 6:
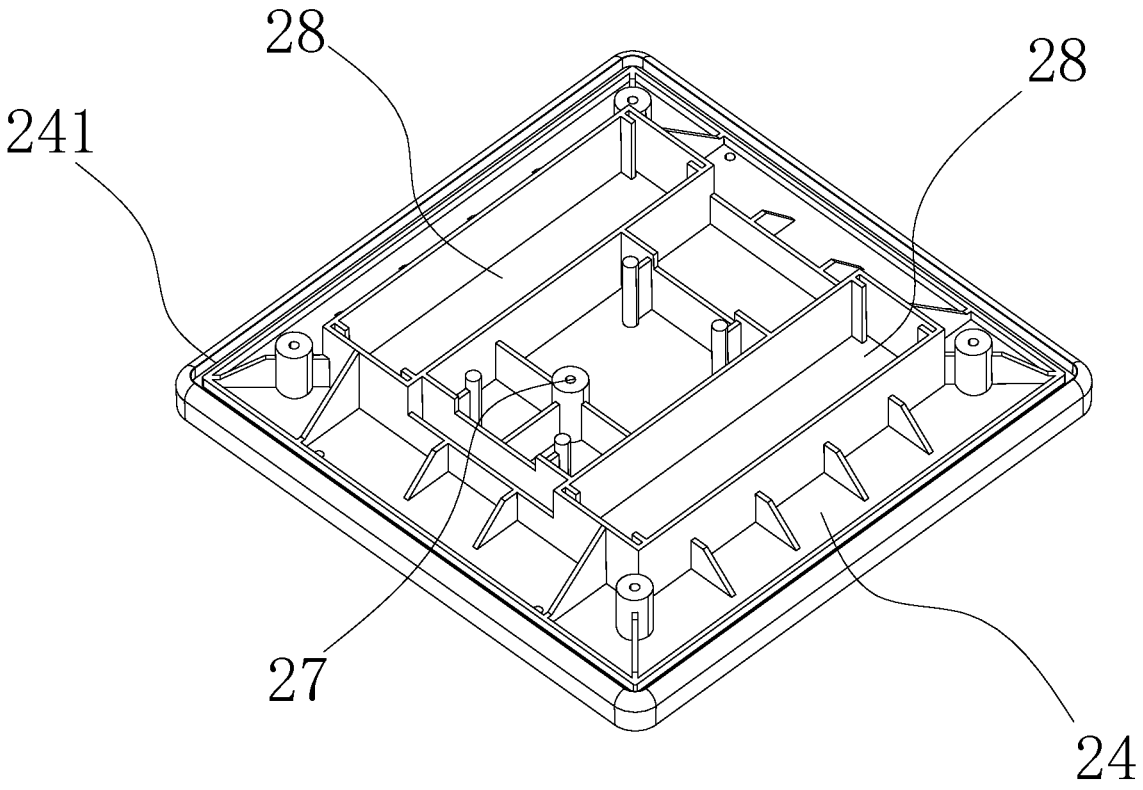
FIG. 6 is an overall schematic structural view of the top cover of the tent center hub.

As shown in FIG. 5 and FIG. 6, the top seat 2 comprises a top cover 24 and a lower housing 25; the top cover 24 and the lower hosing 25 are removably connected via tightening pieces such as bolts or screws; a cavity is defined between the top cover 24 and the lower housing 25; a positioning groove 26 for mounting solar cells is provided at a top side of the top cover 24; a plurality of mounting studs 27 for mounting a solar energy control board are provided at a middle part of a bottom side of the top cover 24; two side portions of the bottom side of the top cover 24 are symmetrically arranged with two mounting frames 28 respectively for mounting solar storage batteries; edges of the top cover 24 are provided with connecting grooves 241 recessed into the top cover 24; edges of the lower housing 25 are embedded into the connecting grooves 241 of the top cover; a USB charging port 29 is provided inside the lower housing 25; the USB charging port 29 is configured between a press ring 21 and a block ring 11.

The top seat 2 and the frame 1 are removably connected; the cavity inside the top seat 2 and the cavity inside the frame 1 are in mutual communication with each other. Specifically, the top side of the frame 1 is provided with a first connecting ring 15 protruded away from the frame 1; the first connecting ring 15 is disposed within an enclosure of the block ring 11; a bottom side of the top seat 2 is provided with a second connecting ring 22 protruded away from the top seat 2; in the present embodiment, an outer side wall of the first connecting ring 15 has four connecting blocks 16 protruding radially away from the first connecting ring 15; an inner side wall of the second connecting ring 22 is correspondingly provided with four locking grooves 23 recessed radially into the inner side wall of the second connecting ring 22; the four connecting blocks 16 and the four locking grooves 23 correspond to one another respectively; the four connecting blocks 16 are inserted into the corresponding four locking grooves 23 respectively so that the top seat 2 and the frame 1 can be removably connected. In actual production, there may be six or eight connecting blocks 16, and correspondingly there may be six or eight locking grooves 23.

The bottom side of the top seat 2 is also provided with an annular press ring 21 which protrudes away from the top seat 2; the top side of the frame 1 is also provided with an annular block ring 11 which protrudes away from the frame 1; the block ring 11 is disposed within an enclosure of the press ring 21; a gap exists along a longitudinal direction between a bottom side of the press ring 21 and the frame 1; a top surface 12 of the top side of the frame 1 exterior to the block ring 11 has a slanted configuration slanted downwardly from the block ring 11 to a periphery of the frame 1.

On sunny days, open the tent so that the solar energy conversion and storage mechanism at the top of the tent converts solar energy into electrical energy and stores the converted electrical energy. When there is a need, switch on a switch to use the stored electrical energy to light up the light beads.

Embodiment 2

Figure 7:
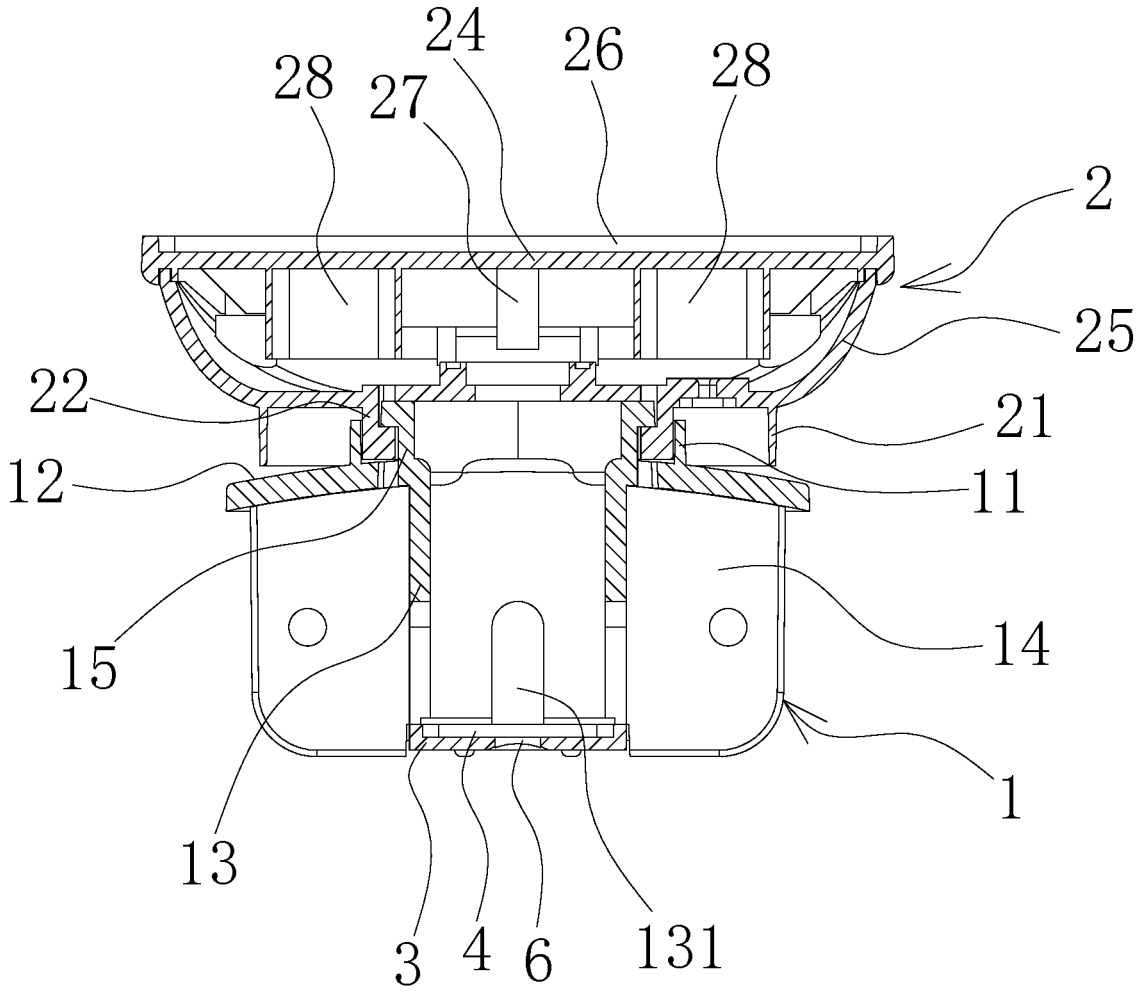
FIG. 7 is an overall sectional structural view according to a second embodiment of the tent center hub.

As shown in FIG. 7, embodiment 2 is almost the same as embodiment 1 in terms of structure and principle, except in that, in embodiment 2, the bottom side of the connecting frame 13 is fixedly connected with the press board 3; the fixing groove 4 wherein a wiring board can be embedded and fixed inside is provided between the connecting frame 13 and the press board 3; a middle part of the press board 3 is provided with a hole 6.

Embodiment 3

Embodiment 3 is almost the same as embodiment 1 in terms of structure and principle, except in that, in embodiment 3, the top side of the frame 1 is provided with the first connecting ring 15 protruded away from the frame 1; the first connecting ring 15 is disposed within an enclosure of the block ring 11; an outer side wall of the first connecting ring 15 is provided with outer threads; the bottom side of the top seat 2 is provided with the second connecting ring 22 protruded away from the top seat 2; an inner side wall of the second connecting ring 22 is provided with inner threads; the first connecting ring 15 and the second connecting ring 22 are threadedly connected with each other so that the top seat 2 and the frame 1 are removably connected with each other.

The embodiments as described above are only illustrative examples of the concept of the present invention. Various changes, additions, or other similar alternative configurations of the described embodiments can be made by a person skilled in this field of art without deviating from the essence of the present invention or exceeding the scope defined by the claims.

Although technical terms like frame 1, block ring 11, top surface 12, connecting frame 13, wiring holes 131, hinging plates 14, first connecting ring 15, connecting blocks 16, top seat 2, press ring 21, second connecting ring 22, locking grooves 23, top cover 24, connecting grooves 241, lower housing 25, positioning groove 26, mounting studs 27, mounting frames 28, USB charging port 29; press board 3, fixing groove 4, lamp shade 5, hole 6, top rod 7, light beads 8, wire 9, and PCB 10 are described above, the possibility of using other technical terms should not be excluded. It should be understood that the use of these technical terms are only intended for more convenient description and explanation of the essence of the present invention. Any interpretation of these terms as additional limitations of the present invention violates the essence of the present invention.

What is claimed is:

1. A tent center hub, comprising a frame that hinges with top rods of a tent, characterized in that, the tent center hub also comprises a top seat adapted to mount a solar energy conversion and storage mechanism; a bottom side of the top seat is provided with an annular press ring protruded away from the top seat; a top side of the frame is provided with an annular block ring protruded away from the frame; the top seat is removably connected to the top side of the frame; a cavity inside the top seat and a cavity inside the frame are in mutual communication with each other; the block ring is disposed within an enclosure of the press ring; a gap exists along a longitudinal direction between a bottom side of the press ring and the frame; the top seat comprises a top cover and a lower housing; the top cover and the lower hosing are removably connected via tightening pieces; a cavity is defined between the top cover and the lower housing; a positioning groove adapted for mounting solar cells is provided at a top side of the top cover: a plurality of mounting studs adapted for mounting a solar energy control board are provided at a middle part of a bottom side of the top cover; two side portions of the bottom side of the top cover are symmetrically arranged with two mounting frames adapted for mounting solar storage batteries respectively.

2. The tent center hub of claim 1, wherein a top surface of the top side of the frame exterior to the block ring has a slanted configuration slanted downwardly from the block ring to a periphery of the frame.

3. The tent center hub of claim 1, wherein the frame comprises a connecting frame which has a polygonal shape; each side of the connecting frame is provided with a pair of hinging plates extending away from the corresponding side of the connecting frame; each pair of hinging plates hinges a corresponding top rod; a wiring hole is provided on each side of the connecting frame between a corresponding pair of hinging plates.

4. The tent center hub of claim 3, wherein a bottom side of the connecting frame is fixedly connected with a press board; a fixing groove adapted for embedding and fixing a wiring board is provided between the connecting frame and the press board; a bottom side of the press board is provided with a lamp shade which is protruded away from the press board.

5. The tent center hub of claim 3, wherein a bottom side of the connecting frame is fixedly connected with a press board; a fixing groove adapted for embedding and fixing a wiring board is provided between the connecting frame and the press board; a middle part of the press board is provided with a hole.

6. The tent center hub of claim 1, wherein the top side of the frame is provided with a first connecting ring protruded away from the frame; the first connecting ring is disposed within an enclosure of the block ring; an outer side wall of the first connecting ring has a plurality of connecting blocks protruding radially away from the first connecting ring; a bottom side of the top seat is provided with a second connecting ring protruded away from the top seat; an inner side wall of the second connecting ring is correspondingly provided with a plurality of locking grooves recessed radially into the inner side wall of the second connecting ring; by inserting the connecting blocks correspondingly into the locking grooves and then by mutual rotation of the frame and the top seat, the top seat and the frame are removably connected with each other.

7. The tent center hub of claim 1, wherein the top side of the frame is provided with a first connecting ring protruded away from the frame; the first connecting ring is disposed within an enclosure of the block ring; an outer side wall of the first connecting ring is provided with outer threads; the bottom side of the top seat is provided with a second connecting ring protruded away from the top seat; an inner side wall of the second connecting ring is provided with inner threads; the first connecting ring and the second connecting ring are threadedly connected with each other so that the top seat and the frame are removably connected with each other.

8. The tent center hub of claim 1, wherein edges of the top cover are provided with connecting grooves recessed into the top cover; edges of the lower housing are embedded correspondingly into the connecting grooves of the top cover.

9. The tent center hub of claim 1, wherein a USB charging port is provided inside the lower housing; the USB charging port is configured between the press ring and the block ring.

* * * * *